United States Patent [19]

Inaba

[11] Patent Number: 4,722,476

[45] Date of Patent: Feb. 2, 1988

[54] APPARATUS FOR AXIALLY ALIGNING A VEHICLE

[75] Inventor: Yoshisada Inaba, Osaka, Japan

[73] Assignee: Kabushiki Kaisha Shinsei, Japan

[21] Appl. No.: 900,896

[22] Filed: Aug. 27, 1986

[30] Foreign Application Priority Data

Sep. 9, 1985 [JP] Japan ..... 60-137748[U]

[51] Int. Cl.[4] ..... B60S 13/00; E04H 6/42

[52] U.S. Cl. ..... 238/4; 33/203.12; 414/228

[58] Field of Search ..... 33/203.12, 203.14, 180 AT, 33/181 AT, 644; 269/55, 58, 139, 151, 227, 250, 256; 238/1, 10 R, 17, 18, 3, 4; 267/150; 414/227, 228; 104/242, 249; 254/90

[56] References Cited

U.S. PATENT DOCUMENTS

| | | | |
|---|---|---|---|
| 1,696,238 | 12/1928 | Isbell | 238/3 |
| 2,676,659 | 4/1954 | Emmer | 269/227 X |
| 2,962,980 | 12/1960 | Carrigan | 33/203.12 X |
| 3,199,783 | 8/1965 | Hurst | 238/4 |
| 3,746,251 | 7/1973 | Bernardi et al. | 238/4 |
| 3,771,781 | 11/1973 | Lackey et al. | 269/227 X |
| 4,445,278 | 5/1984 | Staudinger | 33/203.12 |
| 4,498,243 | 2/1985 | Kashiwagi | 33/203.12 |

FOREIGN PATENT DOCUMENTS 0253369 4/1967 Austria .

*Primary Examiner*—Robert B. Reeves
*Assistant Examiner*—Scott H. Werny
*Attorney, Agent, or Firm*—Sixbey, Friedman & Leedom

[57] ABSTRACT

An apparatus for positioning an automobile in an extremely limited area such as that in a parking lot. The apparatus has a pair of carriages for carrying left and right wheels of the vehicle and movable in the breadthwise direction of the vehicle, a pair of guide bars having inclined portions for progressively engaging the inner or outer surfaces of the vehicle wheels as the vehicle moves onto the apparatus, a spring for urging the guide bars to standard positions where the guide bars are in symmetry with each other with respect to the longitudinal axis of the limited area, and a racks-and-pinion mechanism which is arranged such that, when one of the guide bars is displaced by the vehicle wheel in the breadthwise direction of the vehicle, the other guide bar also is moved in such a manner that both guide bars are always maintained in symmetry with each other with respect to the axis of the limited area.

9 Claims, 6 Drawing Figures

APPARATUS FOR AXIALLY ALIGNING A VEHICLE

BACKGROUND OF THE INVENTION

The present invention relates to an apparatus for positioning a vehicle and, more particularly, to an apparatus for positioning a vehicle such as an automobile correctly at a designated position without requiring specific skill of the driver or operator.

Drivers are often required to position automobiles correctly in an extremely limited area such as that in a parking lot, automatic washer, testing machine, car transporter, and so forth. In such a case, the automobile has be placed without substantial deviation from the aimed area and without any inclination with respect to the center line or the axis of the aimed area. This in turn requires a high degree of skill, as well as much concentration and manual effort. Hitherto, a system has been proposed in which guide gutters are provided for guiding the automobile to the designated position. This system, however, is still unsatisfactory in that it requires a certain level of skill for the driver to drive the vehicle into the guide gutters and in that the guide gutters are not adjustable and, hence, cannot adapt to a wide variety of vehicles.

SUMMARY OF THE INVENTION

Accordingly, an object of the present invention is to provide an apparatus for positioning a vehicle automatically and correctly at a designated position without requiring any specific skill of the driver, thereby obviating the problems explained above.

To this end, according to the invention, there is provided an apparatus for automatically positioning an automobile comprising: carriages arranged such that front wheels of a vehicle can roll thereonto, the carriages being movable in the breadthwise direction of the vehicle; a pair of guide bars arranged above the carriages in symmetry with each other with respect to the center line of an area in which the automobile is to be positioned, the guide bars being movable in the breadthwise direction of the vehicle; at least one pair of rack bars connected to respective guide bars and extending substantially orthogonally to the guide bars towards the opposite guide bars, the racks being arranged such that the toothed sides thereof face each other; a common pinion meshing with both racks; and an urging means for urging the guide bars to respective standard positions.

In operation, as a vehicle is driven onto the carriages at an offset or inclination to the center line between the pair of guide bars, one of the guide bars is displaced by corresponding front wheel of the vehicle. Needless to say, the engagement between the racks and pinion always maintain the guide bars in symmetry with each other with respect to the center line. The displacement of the guide bars loads the urging means which in turn tends to move the guide bars back to the standard positions. Since the front wheels of the vehicle are carried by carriages which are movable in the breadthwise direction of the vehicle, the front wheels and, hence, the front portion of the vehicle is centralized by the guide bars which are moved to the standard positions by the force of the urging means. The rear wheels and, hence, the rear portion of the automobile also are centralized in the same manner.

The above and other objects, features and advantages of the invention will become clear from the following description of the preferred embodiments when the same is read in conjunction with the accompanying drawings.

BRIEF DESCRIPTION OF THE DRAWNGS

DESCRIPTION OF THE PREFERRED EMBODIMENT

Figure 1:
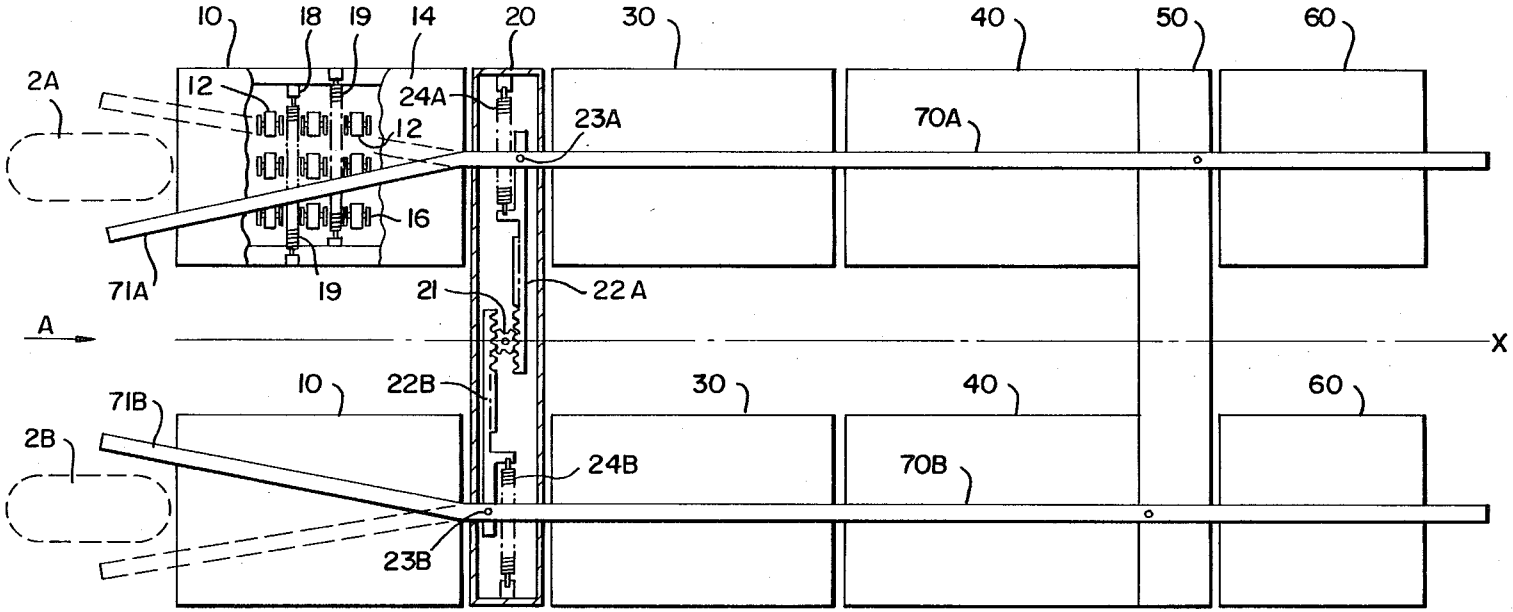
FIG. 1 is a partly cut-away schematic plan view of an embodiment of an apparatus of the invention for positioning a vehicle.

Referring first to FIG. 1, an apparatus embodying the present invention for positioning a vehicle has a pair of first carriages 10 and 10 which are arranged in symmetry to each other with respect to the longitudinal axis X of the area in which the vehicle is to be positioned. These first carriages are spaced from each other by a distance substantially equal to the distance between both front wheels of the vehicle so that the front wheels can roll onto these carriages as the vehicle move onto the apparatus in the direction indicated by an arrow A. The apparatus further has a first guide bar carrier 20 carrying a pair of guide bars which will be mentioned later. The first guide bar carrier 20 is disposed behind the first carriages 10 and 10 as viewed in the direction A of movement of the vehicle. The apparatus further has a pair of second carriages 30 and 30, a pair of stationary platforms 40 and 40, a second guide bar carrier 50, and a third pair of carriages 60 and 60, which are arranged in the mentioned order as viewed in the direction A of movement of the vehicle. The first carriages 10 and 10, first guide bar carrier 20, second pair of carriages 30 and 30, second guide bar carrier 50, and the third pair of carriages 60 and 60 are arranged such that their upper surfaces present a levelled horizontal plane. The pair of guide bars 70A and 70B mentioned above are extended in the direction of the longitudinal axis of the vehicle, i.e., in parallel with the aforementioned axis X, in symmetry with each other with respect to the axis X. These guide bars 70A and 70B are bent towards each other at their entrance ends 71A and 71B, i.e., the ends above the first pair of carriages 10 and 10, so that the guide bars 70A, 70B engage with the inner sides of the left and right front wheels of the vehicle as the vehicle move onto the first carriages 10 and 10.

The first guide bar carrier 20 and the second guide bar carrier 50, which commonly support the guide bars 70A and 70B, have an identical construction. The following description of the construction of the first guide bar carrier 20, therefore, applies also to the second guide bar carrier 50. The first guide bar carrier 20 has a pinion 21 which is disposed on the axis A and rotatable about a vertical axis. A pair of rack bars 22A and 22B are arranged in symmetry with respect to the pinion 21 with their toothed sides facing each other and meshing with the pinion 21. These rack bars extend in the direction perpendicular to the axis X and are guided by a suitable guide means such that they can move in the longitudinal direction thereof. The rack bars 22A and 22B are provided at their base ends with projections 23A and 23B which project upwardly to a level above the guide bar carrier 20. The guide bars 70A and 70B are secured to the projections 23A and 23B. In order to permit any difference in the deviation to occur between both ends of each guide bar, the guide bar is allowed to rotate about its associated projection within a small given range. Coiled springs 24A and 24B are loaded between the rack bars 22A, 22B and the adjacent breadthwise ends of the first guide bar carrier 20 so as to urge the rack bars 22A and 22B and, hence, the guide bars 70A and 70B to respective standard positions. It will be understood that, when either one of the guide bars is contacted by the adjacent front wheel of the vehicle so as to be displaced inwardly, the other guide bar also is moved inwardly by virtue of the engagement between two rack bars 22A, 22B through the pinion 21, in such a manner that two guide bars 70A and 70B are always maintained in symmetry with respect to the axis A. The movement of the rack bars 22A and 22B naturally loads the coiled springs 24A and 24B so that the coiled springs 24A and 24B produce forces which act to reset respective guide bars 70A and 70B to the standard positions.

Figure 2:
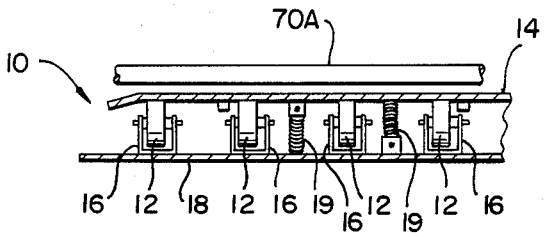
FIG. 2 is an enlarged side elevational view of the embodiment shown in FIG. 1.

The second and third carriages 30,30 and 60,60 have a construction identical to the first carriages 10, 10. The construction of the first carriages 10,10, therefore, will be explained by way of example. Referring to FIGS. 1 and 2, each carriage 10 has a platform 14 which is carried by a plurality of rollers 12 so that it is movable in the breadthwise direction of the vehicle, i.e., in the direction perpendicular to the axis X. Each roller 12 in turn is rotatably supported by a bracket 16 which is situated on a base 18. As will be seen from FIG. 2, a pair of coiled springs 19 and 19 are loaded between the base 18 and the platform 14 so as to urge the platform 14 to a normal position. Preferably, the coiled springs 19 and 19 produce a total force which is small enough to permit a smooth movement of the platform 14 caused by the resetting movement of the guidebars 70A, 70B but large enough to reset the platform 14 to the normal position after the vehicle wheel has left the platform 14.

The operation of the described embodiment will be explained hereinunder with reference to FIGS. 3 to 6.

Figure 3:
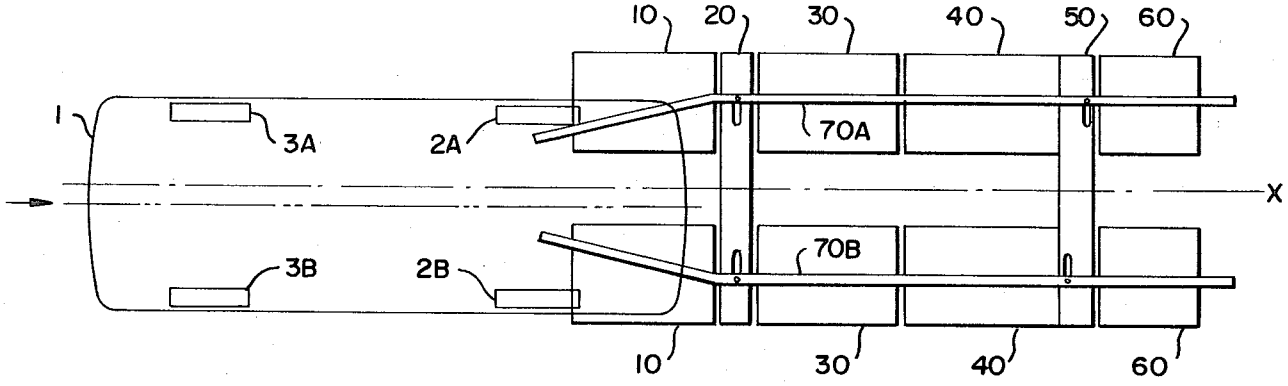
FIGS. 3 to 6 are plan views of the embodiment shown in FIG. 1 in different steps of operation.
Figure 4:
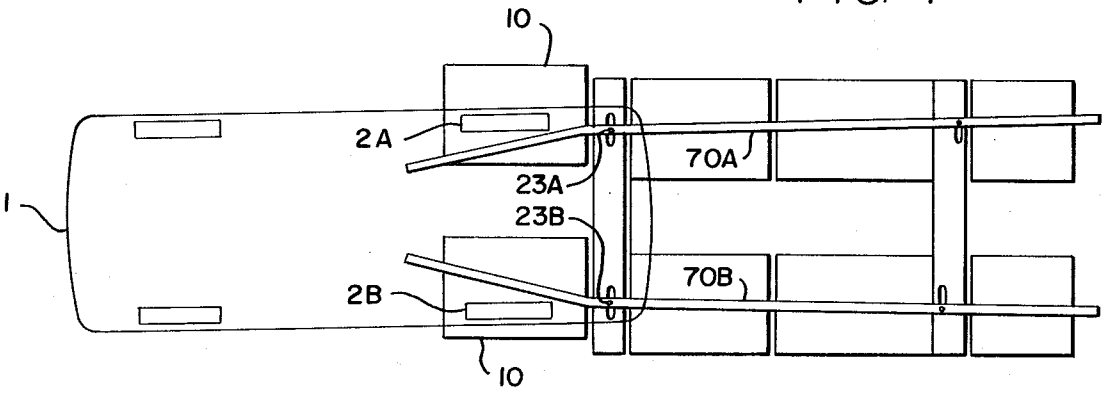
Figure 5:
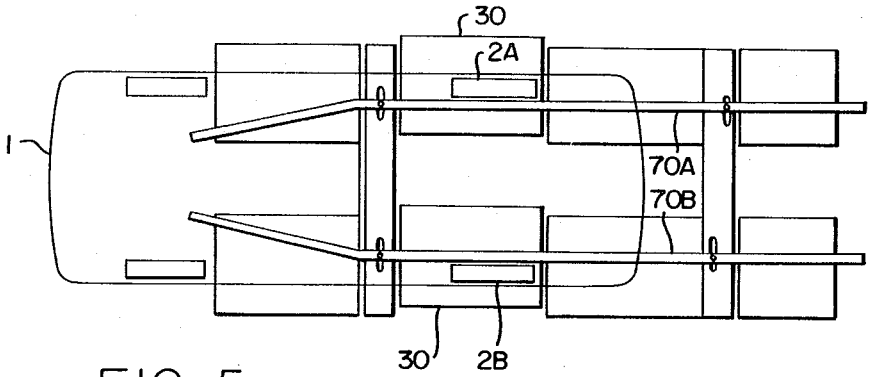
Figure 6:
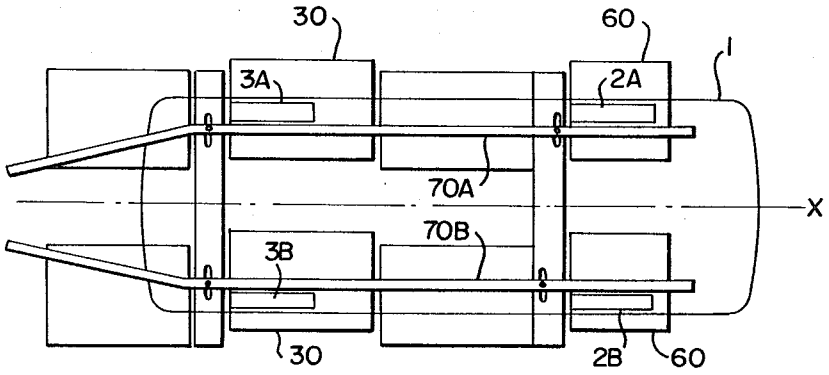

Referring first to FIG. 3, a vehicle 1 to be positioned has approached and its front wheels 2A and 2B are going to roll onto the first carriages 10 and 10. In this state, the longtudinal axis of the vehicle 1 is offset from the axis X of the area in which the vehicle is to be positioned, so that the left front wheel 2A of the vehicle first comes into contact with the adjacent guide bar 70A as illustrated. As the vehicle 1 further moves in the direction of the arrow, the left front wheel 2A forcibly displaces the guide bar 70A inwardly, i.e., towards the other guide bar 70B, while loading the spring 24A and, therefore, the spring 24B through the meshing racks and pinion. In consequence, the springs 24A and 24B produce a force which acts to reset both guide bars 70A and 70B to the standard positions, which in turn causes the front wheels 2A and 2B and, therefore, the carriages 10 and 10 to be moved leftward of the vehicle, i.e., upward as viewed in the Figures. It will be seen that, since the portions of the guide bars 70A and 70B on the second guide bar carrier 50 are not loaded substantially and held almost unmoved, and since the projections 23A and 23B support the guide bars in such a manner as to permit a limited rotation of the guide bars 70A and 70B thereabout, the guide bars 70A and 70B are inclined slightly inwardly in a manner shown in FIG. 4. It will be seen that, during the described operation of the apparatus, the pair of rack bars 22A and 22B are held always in symmetry with each other with respect to the axis X, due to the meshing engagement between these rack bars 22A, 22B and the pinion 21. Then, as the vehicle 1 further moves in the direction of the arrow, the front wheels 2A and 2B of the vehicle roll onto the second carriages 30 and 30. A further resetting movement of the guide bars 70A and 70B towards the standard positions causes the front wheels 2A and 2B to be moved together with the second carriages 30 and 30 as shown in FIG. 5. When the front wheels 2A and 2B rest on the third carriages 60 and 60 as a result of a further movement of the vehicle, the rear wheels 3A and 3B roll onto the first carriages 10 and 10, as shown in FIG. 6. In this state, the guide bars 70A and 70B have been reset almost completely to the standard positions, and the guide bar 70B has been brought into contact with the inner surfaces of the front and rear right wheels 2B and 3B, whereby the vehicle is positioned substantially in alignment with the axis X of the designated area.

During the operation of the apparatus, the driver need not operate the steering wheel, once either the left or right front wheel of the vehicle is contacted by the associated guide bar. Namely the driver is required only to hold the steering wheel and slowly drive the vehicle into the designated area, so as to enable the apparatus to automatically centralize the vehicle with respect to the designated area in the manner described before.

It will be understood that the guide bars 70A and 70B need not be completely reset to the standard positions when the vehicle is correctly positioned, since the vehicle is substantially centralized when its left and right wheels are contacted at their inner sides by the guide bars. Thus, the apparatus of the invention can apply to a variety of sizes of vehicles, provided that the distance between two guide bars at their standard positions is selected to be equal to or slightly smaller than the possible smallest distance between left and right wheels of vehicles.

The apparatus of the invention for positioning vehicles enables, by an extremely simple construction employing racks-and-pinion mechanism which maintain a pair of guide bars in symmetry with respect to each other, a vehicle to be correctly positioned in the designated area, regardless of the distance between the left and right wheels of the vehicle.

Although the invention has been described through its preferred form, the described embodiment is only illustrative and various changes and modifications may be imparted thereto. For instance, the pair of guide bars may be arranged such that they contact the wheels of the vehicle from the outer side so as to centralize the vehicle, unlike the described embodiment in which the guide bars engage the inner surfaces of the vehicle wheels. In such a case, the entrance ends of the guide bars above the first carriages are bent such that they converge towards the inner side of the apparatus.

Other changes and modifications are still possible without departing from the scope of the invention which is limited solely by the appended claims.

What is claimed is:

1. An apparatus for positioning a vehicle having right and left wheels mounted on either side of its width, comprising:

a platform adapted to receive the right and left wheels of the vehicle thereon, said platform being movable along a path parallel to the width of the vehicle;

a pair of guide bars adapted to engage the wheels of the vehicle arranged above said platform and symmetrically disposed both with each other and with respect to a center line of an area in which the vehicle is to be positioned, said guide bars being movable along a path parallel to the width of the vehicle;

at least one pair of toothed rack bars respectively connected to said guide bars, each one of said rack bars extending substantially orthogonally to said respective guide bars towards the other so that toothed rack bars face each other;

a common pinion meshing with the teeth of both said rack bars; and a spring for urging said guide bars toward a specific position along their path of movement.

2. An apparatus for positioning a vehicle as set forth in claim 1, wherein said guide bars are oriented substantially parallel to the center line of said area in which the vehicle is to be positioned.

3. An apparatus for positioning a vehicle as set forth in claim 3, wherein said guide bars are arranged to engage an inward facing portion of at least one of the right and left wheels of the vehicle when the vehicle enters onto said platform.

4. An apparatus for positioning a vehicle as set forth in claim 4, wherein said guide bars include entrance ends that are bent inwardly towards each other.

5. An apparatus for positioning a vehicle as set forth in claim 3, wherein said guide bars are arranged to engage an outward facing portion of at least one of the right and left wheels of the vehicle when the vehicle enters onto said platform.

6. An apparatus for positioning a vehicle as set forth in claim 6, wherein include entrance ends that said guide bars are bent outwardly from each other.

7. An appartus for positioning a vehicle as set forth in claim 1, futher comprising a second urging means for urging said platform to a specific position along its path of movement so that said platform returns to said specific position after the wheels of the vehicle have left said platform.

8. An apparatus for positioning a vehicle having right and left wheels mounted on either side of its width, comprising:

a platform adapted to receive the right and left wheels of the vehicle thereon, said platform being movable along a path parallel to the width of the vehicle;

a pair of guide bars adapted to engage the wheels of the vehicle arranged above said platform and symmetrically disposed both with each other and with respect to a center line of an area in which the vehicle is to be positioned, said guide bars being movable along a path parallel to the width of the vehicle;

at least one pair of toothed rack bars respectively connected to said guide bars, each one of said rack bars extending substantially orthogonally to said respective guide bars towards the other so that toothed rack bars face each other;

a common pinion meshing with the teeth of both said rack bars, wherein said rack bars are all movably mounted in a guide bar carrier means, and an urging means connected at one end to at least one rack bar and at the other end to said guide bar carrier means for urging said guide bars toward a specific position along their path of movements.

9. An apparatus for positioning a vehicle having right and left wheels mounted on either side of its width, comprising:

at least two platforms adapted to receive the right and left wheels of the vehicle thereon, wherein each of said platforms is movable independently of the other along a path parallel to the width of the vehicle, a pair of guide bars disposed above said platforms adapted to engage the wheels of the vehicle arranged above said platform and symmetrically disposed both with each other and with respect to a center line of an area in which the vehicle is to be positioned, said guide bars being movable along a path parallel to the width of the vehicle;

at least one pair of toothed rack bars respectively connected to said guide bars, each one of said rack bars extending substantially orthogonally to said respective guide bars towards the other so that toothed rack bars face each other;

a common pinion meshing with the teeth of both said rack bars, wherein said rack bars are all movably mounted in a guide bar carrier means, and an urging means for urging said guide bars towards a specific position along their path of movement.

* * * * *